US008844081B2

(12) United States Patent
Joo

(10) Patent No.: US 8,844,081 B2
(45) Date of Patent: Sep. 30, 2014

(54) METHOD OF CONTROLLING THE OPENING OF DOOR OF LAUNDRY TREATMENT MACHINE

(75) Inventor: Young Hoon Joo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1041 days.

(21) Appl. No.: 11/836,380

(22) Filed: Aug. 9, 2007

(65) Prior Publication Data

US 2008/0039976 A1 Feb. 14, 2008

(30) Foreign Application Priority Data

Aug. 14, 2006 (KR) ..... 10-2006-0076764

(51) Int. Cl.
*D06F 35/00* (2006.01)
*D06F 37/42* (2006.01)
*D06F 33/02* (2006.01)

(52) U.S. Cl.
CPC ..... *D06F 37/42* (2013.01); *D06F 33/02* (2013.01)
USPC ..... 8/158; 68/12.22

(58) Field of Classification Search
USPC ..... 8/158, 159; 68/12.01, 12.02, 12.03, 68/12.05, 12.14, 12.19, 12.21, 12.22, 68/12.26
See application file for complete search history.

(56) References Cited

U.S. PATENT DOCUMENTS

| | | | | |
|---|---|---|---|---|
| 2004/0107509 | A1* | 6/2004 | Kim et al. | 8/158 |
| 2005/0120492 | A1* | 6/2005 | Koo et al. | 8/159 |
| 2006/0000031 | A1* | 1/2006 | Hoppe | 8/159 |
| 2006/0112498 | A1* | 6/2006 | Roh et al. | 8/158 |

FOREIGN PATENT DOCUMENTS

| | | |
|---|---|---|
| DE | 101 48 452 | 5/2003 |
| KR | 10-0262882 | 5/2000 |

OTHER PUBLICATIONS

Machine Translation of KR 10-0262882, Aug. 2000.*
German Office Action dated May 27, 2010 with English language translation.

* cited by examiner

*Primary Examiner* — David Cormier
(74) *Attorney, Agent, or Firm* — Ked & Associates, LLP

(57) ABSTRACT

A method of controlling the opening of a door of a laundry treatment machine is provided. According to the method, when a door opening signal is detected during an operation of a laundry treatment machine, the temperature and the water level in a tub are reduced, and then the door of the laundry treatment machine is opened. Thus, it is possible to prevent a user from being burned by hot air or water in the tub and thus to improve the safety of a laundry treatment machine. Also, it is possible to enhance the convenience of a laundry treatment machine by allowing a user to open the door of the laundry treatment machine during an operation of the laundry treatment machine and to additionally put laundry in the laundry treatment machine. In addition, according to the method, wash water is discharged from a tub according to the temperature and the water level in the tub, and then cold water is supplied into the tub. Since the amount of wash water to be discharged from the tub is determined in consideration of the amount of cold water to be supplied into the tub, there is no need to additionally discharge wash water from the tub after the supply of cold water into the tub because the water level in the tub is controlled not to exceed a reference water level after the supply of cold water into the tub. Therefore, it is possible to reduce waiting time of a user.

15 Claims, 4 Drawing Sheets

METHOD OF CONTROLLING THE OPENING OF DOOR OF LAUNDRY TREATMENT MACHINE

This application claims priority from Korean Patent Application No. 10-2006-0076764 filed on Aug. 14, 2007 in the Korean Intellectual Property Office, the disclosure of which is incorporated herein by reference in its entirety.

BACKGROUND OF THE INVENTION

1. Field of the Invention

The present invention relates to a method of controlling the opening of a door of a laundry treatment machine, and more particularly, to a method of controlling the opening of a door of a laundry treatment machine which can improve the safety and convenience of laundry treatment by adjusting the temperature and the water level in a tub and then controlling a door of a laundry treatment machine to be opened according to the results of the adjustment if a user requests the door of the laundry treatment machine to be opened during an operation of the laundry treatment machine.

2. Description of the Related Art

In general, laundry treatment machines are broadly classified into washing machines which remove dirt and dust from laundry using water and detergents and using a mechanical operation, drying machines which dry wet laundry using a heater and using a mechanical operation, and washing/drying machines into which washing machines and drying machines are incorporated.

Recently, an increasing number of laundry treatment machines are being equipped with a warm water washing function which involves supplying warm water into a laundry treatment machine with an additional hose and washing laundry using the warm water, a boiling washing function which involves heating wash water in a tub using a heater and performing a sterilization washing operation at high temperature, and a drying function which involves blowing hot air into a drum and drying laundry in the drum, and thus, the use of laundry treatment machines in a high-temperature environment has increased.

In the meantime, conventional drum-type washing machines include a tub which is disposed in a cabinet and a drum which is installed in the tub to be able to rotate and in which laundry can be loaded. A door is attached to the front of the door and opens or closes the drum. The door is locked or unlocked by a door lock device.

During an operation of a drum-type washing machine, the door of the drum-type washing machine is opened, and laundry is put in the drum of the drum-type washing machine. Thereafter, the door of the drum-type washing machine is closed. Thereafter, wash water is supplied into the drum until the water level in the drum reaches a predefined value. Then, the drum begins to rotate, and thus starts a washing operation.

During a washing operation, a door lock device of a drum-type washing machine maintains the door of the drum-type washing machine to be locked. Thus, a user cannot open the door until the end of the washing operation. Therefore, the user may not be able to additionally put laundry into the drum-type washing machine during the washing operation, thereby causing inconvenience.

SUMMARY OF THE INVENTION

The present invention provides a method of controlling the opening of a door of a laundry treatment machine which can improve the safety and convenience of laundry treatment by allowing a door of a laundry treatment machine to be opened during an operation of the laundry treatment machine.

According to an aspect of the present invention, there is provided a method of controlling the opening of a door of a laundry treatment machine, the method including detecting a door opening signal during an operation of a laundry treatment machine; primarily measuring a temperature in a tub and a water level in the tub; determining an amount of wash water to be discharged from the tub and an amount of cold water to be supplied into the tub according to the results of the primary measurement, and discharging wash water from the tub and supplying cold water into the tub according to the results of the determination; and secondarily measuring the temperature in the tub and the water level in the tub and opening the door of the laundry treatment machine if the results of the secondary measurement indicate that the temperature in the tub is lower than a reference temperature and that the water level in the tub is lower than a reference water level.

The determination may include determining the amount of wash water to be discharged from the tub and the amount of cold water to be supplied into the tub so that the water level in the tub can become lower than the reference water level.

The determination may include determining the amount of wash water to be discharged from the tub by adding up a difference between the water level in the tub and the reference water level and the amount of cold water to be supplied into the tub.

The method may also include opening the door of the laundry treatment machine if the results of the primary measurement indicate that the temperature in the tub is lower than the reference temperature and that the water level in the tub is lower than the reference water level.

The determination may include determining the amount of wash water to be discharged from the tub and the amount of cold water to be supplied into the tub only if the results of the primary measurement indicate that the temperature in the tub is higher than the reference temperature and that the water level in the tub is higher than the reference water level.

The method may also include transmitting a warning signal to a user if the results of the primary measurement indicate that the temperature in the tub is higher than the reference temperature and that the water level in the tub is higher than the reference water level.

The method may be used to perform at least one of a washing operation, a rinsing operation, and a drying operation.

The primary measurement or the secondary measurement may include measuring at least one of a temperature of air in the tub and a temperature of wash water in the tub.

The method may also include transmitting a warning signal to a user if the results of the secondary measurement indicate that the temperature in the tub is higher than the reference temperature and that the water level in the tub is higher than the reference water level.

The method may also include determining that a water supply unit or a water discharge unit has malfunctioned, controlling the door of the laundry treatment machine not to be opened, and notifying a user of the malfunction of the water supply unit or the water discharge unit if the results of the secondary measurement indicate that the temperature in the tub is higher than the reference temperature and that the water level in the tub is higher than the reference water level.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

The present invention will hereinafter be described in detail with reference to the accompanying drawings in which exemplary embodiments of the invention are shown.

A laundry treatment machine according to an embodiment of the present invention will hereinafter be described in detail with reference to the accompanying drawings, taking a drum-type washing machine as an example.

Figure 1:
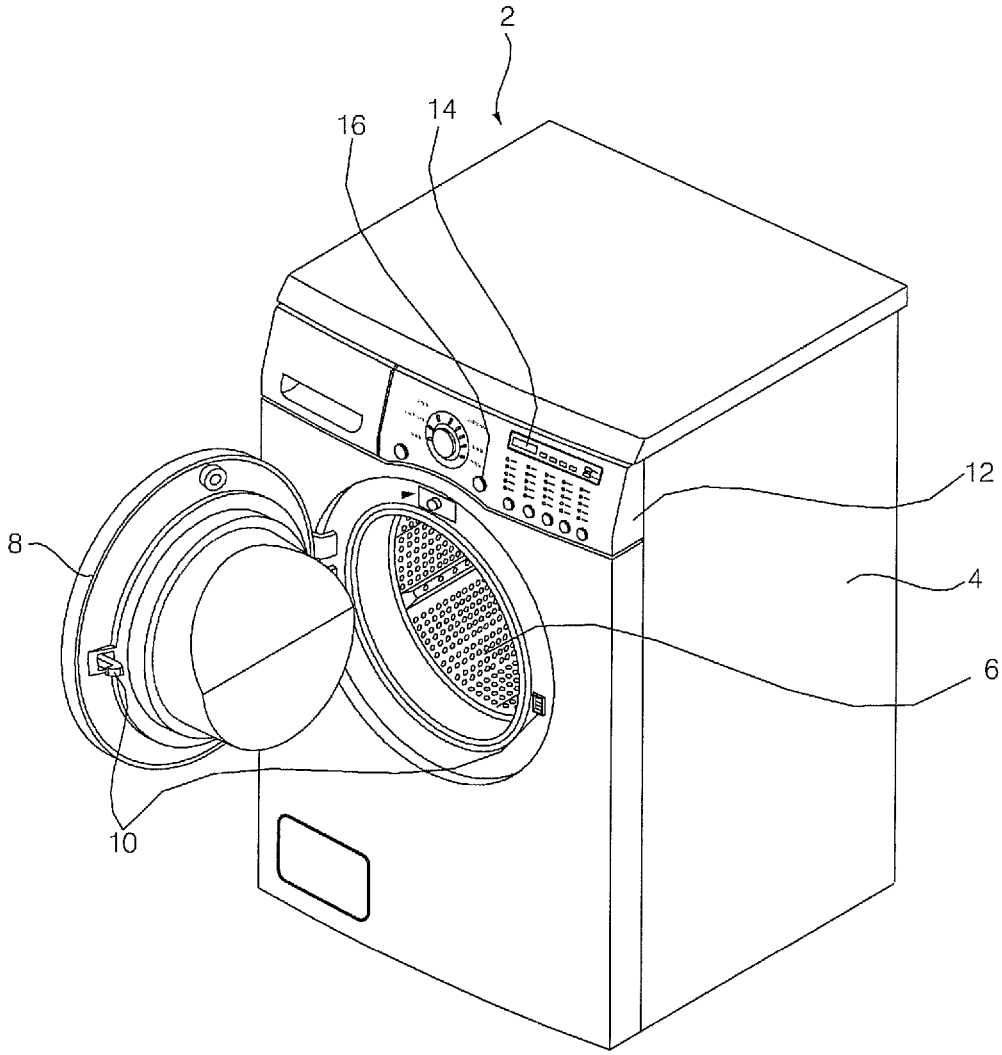
FIG. 1 is a perspective view of a drum-type washing machine according to an embodiment of the present invention.

FIG. 1 is a perspective view of a drum-type washing machine 2 according to an embodiment of the present invention. Referring to FIG. 1, the drum-type washing machine 2 includes a cabinet 4 which defines the exterior of the drum-type washing machine 2; a tub (not shown) which is disposed in the cabinet 4 and contains wash water therein; a drum 6 which is installed in the tub (not shown) and includes a laundry inlet/outlet hole; a motor (not shown) which rotates the drum 6; a door 8 which opens or closes the laundry inlet/outlet hole; a door lock unit 10 which locks or unlocks the door 8; and a control panel 12 which is installed on the cabinet 4 and receives or displays various operating signals for driving the drum-type washing machine 2.

The control panel 12 includes a plurality of buttons and switches for receiving various operating signals for driving the drum-type washing machine 2 and a display unit 14 which displays the operating state of the drum-type washing machine 2 as text or numerals. The switches of the control panel 12 include a door opening switch 16 which is used to put laundry into the drum-type washing machine 2 during an operation of the drum-type washing machine 2.

Figure 2:
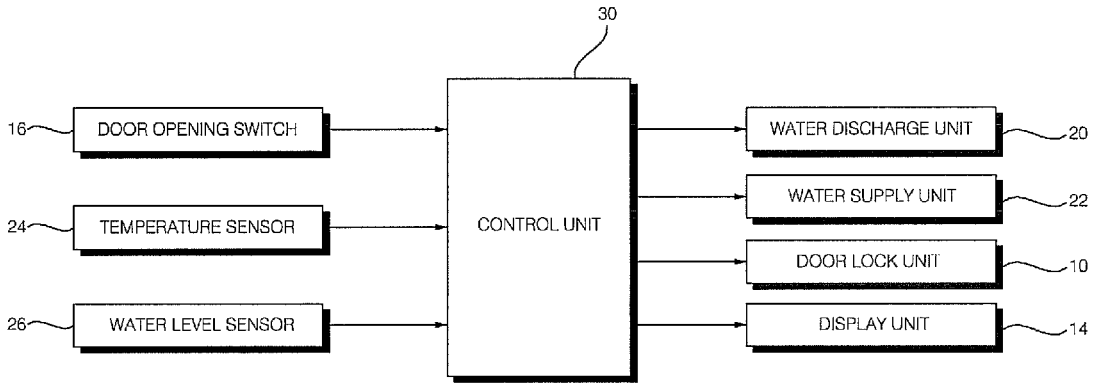
FIG. 2 is a block diagram of the drum-type washing machine illustrated in FIG. 1, according to an embodiment of the present invention.

FIG. 2 is a block diagram of the drum-type washing machine 2 illustrated in FIG. 1, according to an embodiment of the present invention. Referring to FIG. 2, the drum-type washing machine 2 also includes a water supply unit 20 which supplies wash water into the tub, a water discharge unit 22 which discharges wash water contained in the tub, a temperature sensor 24 which measures the temperature in the tub; a water level sensor 26 which measures the water level in the tub, and a control unit 30 which controls the operations of the water supply unit 20, the water discharge unit 22, the door lock unit 10, and the display unit 14.

The temperature sensor 24 may include a water temperature sensor which is installed in the tub and measures the temperature of wash water contained in the tub. However, the present invention is not restricted to this. In other words, the temperature sensor 24 may include an air temperature sensor which measures the temperature of air in the tub.

The control unit 30 may control the operations of the water supply unit 20 and the water discharge unit 22 according to the result of the measurement performed by the temperature sensor 24 and the result of the measurement performed by the water level sensor 26. Also, the control unit 30 controls the operation of the door lock unit 10 according to whether the door opening switch 16 is turned on or off.

A method of controlling the opening of the door 8 of the drum-type washing machine 2 according to an embodiment of the present invention will hereinafter be described in detail.

Figure 3:
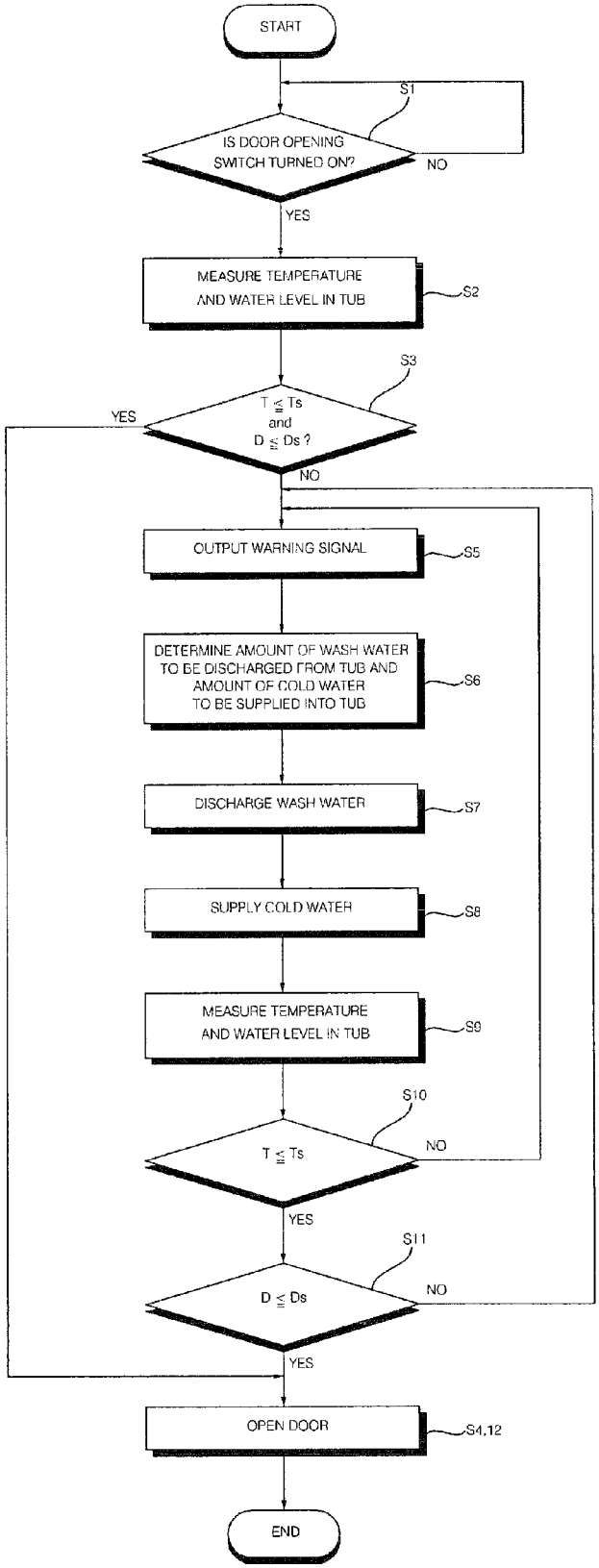
FIG. 3 is a flowchart illustrating a method of controlling the opening of a door of a drum-type washing machine according to an embodiment of the present invention.

FIG. 3 is a flowchart illustrating a method of controlling the opening of a door of a drum-type washing machine according to an embodiment of the present invention. Referring to FIG. 3, a user turns on the door opening switch 16 in order to put laundry into the drum-type washing machine 2 during the operation of the drum-type washing machine 2.

When the door opening switch 16 is turned on, an on signal is transmitted to the control unit 30 (S1).

The temperature sensor 24 measures the temperature T in the tub and transmits a sensing signal corresponding to the result of the measurement to the control unit 30 (S2). Also, the water level sensor 26 measures the water level D in the tub and transmits a sensing signal corresponding to the result of the measurement to the control unit 30, i.e., a water level D1 (S2).

The control unit 30 compares a temperature T1 obtained by the measurement performed by the temperature sensor 24 with a reference temperature Ts, and compares a water level D1 obtained by the measurement performed by the water level sensor 26 with a reference water level Ds (S3).

If the temperature T1 is lower than the reference temperature Ts and the water level D1 is lower than the reference water level Ds, the control unit 30 unlocks the door locking element 10 so that the user can open the door 8 (S4).

If the temperature T1 is higher than the reference temperature Ts and the water level D1 is higher than the reference water level Ds, the control unit 30 maintains the door locking element 10 to be unlocked, and outputs a warning signal indicating that the door 8 cannot be opened to the user (S5).

The warning signal may be output as text by the display unit 14. Alternatively, the warning signal may be output to the user as a sound.

The control unit 30 determines the amount of wash water to be discharged from the tub and the amount of cold water to be supplied into the tub according to the temperature T1 and the water level D1 (S6).

More specifically, the control unit 30 may determine the amount of wash water to be discharged from the tub and the amount of cold water to be supplied into the tub so that the water level D in the tub can become lower than the reference water level Ds, and that the temperature T in the tub can become lower than the reference temperature Ts. In other words, the amount of water to be discharged from the tub may be determined by the amount of cold water to be supplied into the tub and the sum of the difference between the water level D1 and the reference water level.

Once the amount of wash water to be discharged from the tub and the amount of cold water to be supplied into the tub are determined, the control unit 30 drives the water discharge unit 22 to discharge a predetermined amount of wash water from the tub (S7).

Thereafter, the control unit 30 drives the water supply unit 20 to supply a predetermined amount of cold water into the tub (S8).

According to the embodiment of FIG. 3, the amount of wash water to be discharged from the tub is determined in consideration of the amount of cold water to be supplied into the tub after the discharge of wash water from the tub. Therefore, it is possible to minimize the amount of cold water that needs to be supplied into the tub. Also, according to the embodiment of FIG. 3, there is no need to discharge wash water from the tub after the supply of cold water into the tub. Thus, it is possible to reduce waiting time of a user for opening the door 8.

Due to the discharge of a predetermined amount of wash water from the tub, the water level D in the tub decreases. In addition, due to the supply of a predetermined amount of cold water into the tub, the temperature T in the tub decreases.

Thereafter, the temperature T in the tub and the water level D in the tub are measured again (S9).

Thereafter, a temperature T2 obtained by the measurement performed in S9 is compared with the reference temperature Ts (S10).

Thereafter, a water level D2 obtained by the measurement performed in S9 is compared with the reference water level Ds (S11).

If the temperature T2 is lower than the reference temperature Ts and the water level D2 is lower than the reference water level Ds, the door lock unit 10 is unlocked so that the door 8 can be opened (S12).

On the other hand, if the temperature T2 is higher than the reference temperature Ts and the water level D2 is higher than the reference water level Ds, a warning signal is output, and the method returns to operation S5.

The method illustrated in FIG. 3 may be applied for use in washing and rinsing operations. Also, the method illustrated in FIG. 3 may be applied for use in a drying operation if the drum-type washing machine 2 illustrated in FIG. 1 has a drying function.

Figure 4:
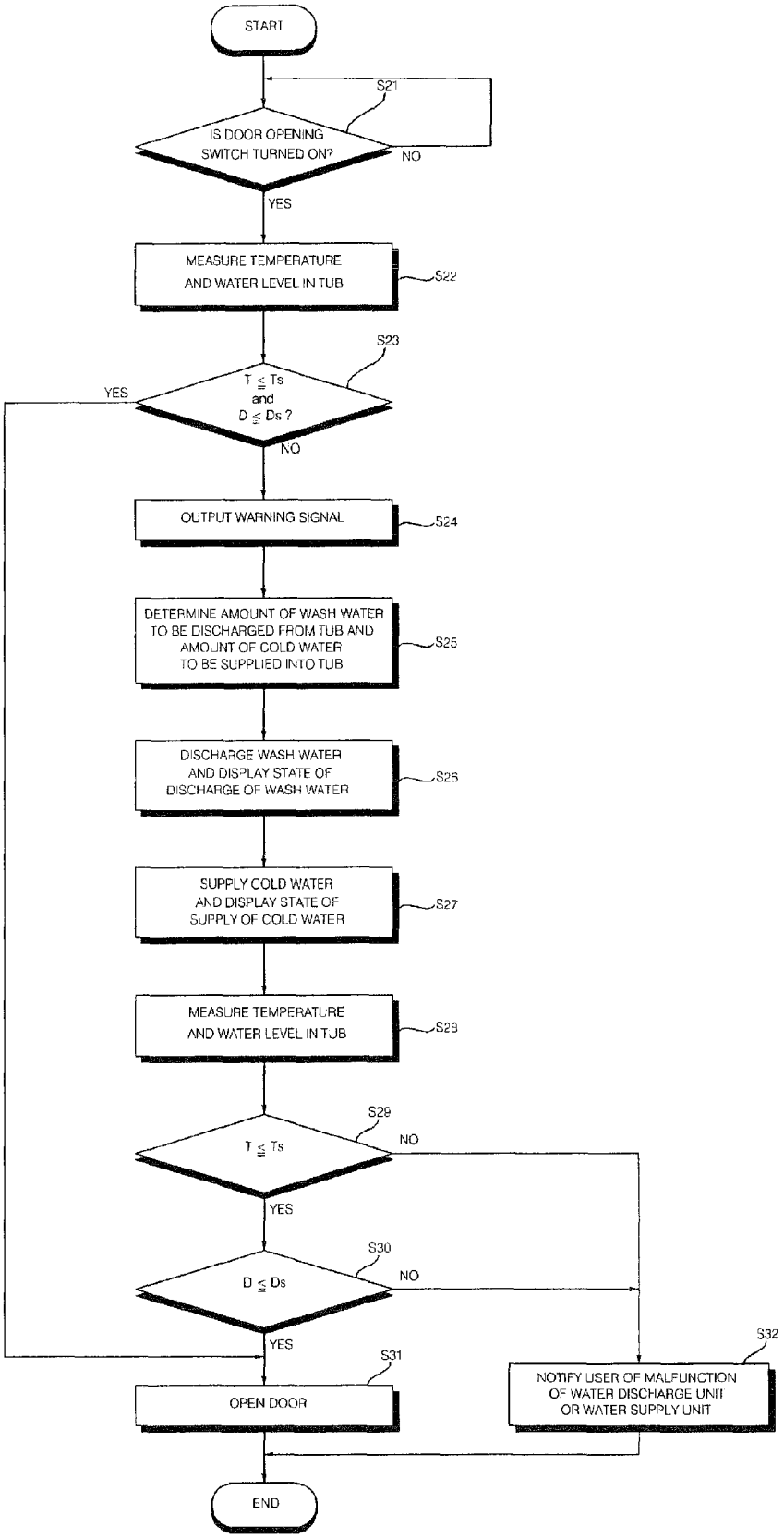
FIG. 4 is a flowchart illustrating a method of controlling the opening of a door of a drum-type washing machine according to another embodiment of the present invention.

FIG. 4 is a flowchart illustrating a method of controlling the opening of a door of a drum-type washing machine according to another embodiment of the present invention. Referring to FIG. 4, it is determined whether the door opening switch 16 is turned on or off (S21).

When the door opening switch 16 is turned on, the temperature T in the tub and the water level D in the tub are measured (S22).

A temperature T1 obtained by the measurement performed in operation S22 is compared with a reference temperature Ts, and a water level D1 obtained by the measurement performed in operation S22 is compared with a reference water level Ds (S23).

If the temperature T1 is higher than the reference temperature Ts and the water level D1 is higher than the reference water level Ds, a warning signal is output to a user with the aid of the display unit 14 (S24).

Thereafter, the amount of water to be discharged from the tub and the amount of cold water to be supplied into the tub are determined according to the temperature T1 and the water level D1 (S25).

A predetermined amount of wash water is discharged from the tub according to the results of the determination performed in S25, and a signal indicating the discharge of wash water from the tub is output (S26). A predetermined amount of cold water is supplied into the tub according to the results of the determination performed in S25, and a signal indicating the supply of cold water into the tub is output (S27).

When the supply of cold water into the tub is completed, the temperature T in the tub and the water level D in the tub are measured again (S28).

Thereafter, a temperature T2 obtained by the measurement performed in operation S28 is compared with the reference temperature Ts (S29), and a water level D2 obtained by the measurement performed in operation S28 is compared with the reference water level Ds (S30).

If the temperature T2 is lower than the reference temperature Ts and the water level D2 is lower than the reference water level Ds, the door lock unit 10 is unlocked so that the door 8 can be opened (S31).

On the other hand, if the temperature T2 is higher than the reference temperature Ts or the water level D2 is higher than the reference water level Ds, it is determined that the discharge of wash water from the tub or the supply of cold water into the tub has not been successful due to malfunction of the water supply unit 20 and/or the water discharge unit 22. Then, a signal indicating the malfunction of the water supply unit 20 and/or the water discharge unit 22 is output to the user with the aid of the display unit 14 (S32).

As described above, according to the present invention, when a door opening signal is detected during an operation of a laundry treatment machine, the temperature and the water level in a tub are reduced, and then the door of the laundry treatment machine is opened. Thus, it is possible to prevent a user from being burned by hot air or water in the tub and thus to improve the safety of a laundry treatment machine. Also, it is possible to enhance the convenience of a laundry treatment machine by allowing a user to open the door of the laundry treatment machine during an operation of the laundry treatment machine and to additionally put laundry in the laundry treatment machine.

In addition, according to the present invention, wash water is discharged from a tub according to the temperature and the water level in the tub, and then cold water is supplied into the tub. Since the amount of wash water to be discharged from the tub is determined in consideration of the amount of cold water to be supplied into the tub, there is no need to additionally discharge wash water from the tub after the supply of cold water into the tub because the water level in the tub is controlled not to exceed a reference water level after the supply of cold water into the tub. Therefore, it is possible to reduce waiting time of a user.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of controlling opening of a door of a laundry treatment machine, the method comprising:

(a) detecting a door opening signal during an operation of a laundry treatment machine;

(b) primarily measuring a temperature in a tub and measuring a water level in the tub;

(c) determining that the measured temperature is higher than a reference temperature;

(d) determining that the measured water level is higher than a reference water level;

(e) determining an amount of wash water to be discharged from the tub when the measured temperature is determined to be higher than the reference temperature and the measured water level is determined to be higher than the reference water level;

(f) determining an amount of cold water to be supplied into the tub, (g) discharging the determined amount of wash water from the tub after determining the amount of cold water to be supplied, wherein the determined amount of wash water is determined by subtracting the reference water level from the measured water level in (b) and adding the determined amount of cold water;

(h) supplying the determined amount of cold water to the tub after discharging the determined amount of wash water from the tub;

(i) secondarily measuring the temperature in the tub and measuring the water level in the tub during the operation of the laundry treatment machine and after supplying the determined amount of cold water;

(j) determining that the measured temperature in (i) is lower than the reference temperature and determining that the measured water level in (i) is lower than the reference water level; and (k) opening the door, based on the door opening signal, when the measured temperature in (i) is determined to be lower than the reference temperature and the measured water level in (i) is determined to be lower than the reference water level.

2. The method of claim 1, further comprising transmitting a warning signal to a user when the measured temperature in (b) is determined to be higher than the reference temperature and the measured water level in (b) is determined to be higher than the reference water level.

3. The method of claim 1, wherein the operation of the laundry treatment machine is a washing operation or a rinsing operation.

4. The method of claim 1, wherein measuring the temperature in the tub includes measuring a temperature of air in the tub or measuring a temperature of wash water in the tub.

5. The method of claim 1, further comprising:

transmitting a warning signal to a user when the measured temperature in (i) is determined to be higher than the reference temperature and the measured water level in (i) is determined to be higher than the reference water level.

6. The method of claim 1, further comprising:

controlling the door not to be opened when the measured temperature in (i) is determined to be higher than the reference temperature and the measured water level in (i) is determined to be higher than the reference water level.

7. The method of claim 1, further comprising:

transmitting a signal indicating a state of the discharge of wash water to the user; and transmitting a signal indicating a state of the supply of cold water to the user.

8. The method of claim 5, wherein the warning signal is a signal notifying the user of a malfunction of a water supply unit or a water discharge unit.

9. A method of controlling a laundry treatment machine, the method comprising:

detecting a door opening signal during a washing operation or a rinsing operation;

measuring a first temperature in a tub and measuring a first water level in the tub in response to detecting the door opening signal;

determining that the measured first temperature is higher than a reference temperature;

determining that the measured first water level is higher than a reference water level;

calculating a specific amount of wash water to be discharged from the tub when the measured first temperature is determined to be higher than the reference temperature and the measured first water level is determined to be higher than the reference water level;

determining a specific amount of cold water to be supplied into the tub;

discharging the calculated specific amount of wash water from the tub after determining the specific amount of cold water, wherein the calculated specific amount of wash water is calculated by subtracting the reference water level from the measured first water level and adding the determined specific amount of cold water;

supplying the specific amount of cold water to the tub;

determining a second temperature in the tub and determining a second water level in the tub after supplying the determined specific amount of cold water to the tub;

determining that the second temperature is lower than the reference temperature;

determining that the second water level is lower than the reference water level; and opening the door when the second temperature is determined to be lower than the reference temperature and the second water level is determined to be lower than the reference water level.

10. The method of claim 9, further comprising transmitting a warning signal when the measured first temperature is determined to be higher than the reference temperature and the measured first water level is determined to be higher than the reference water level.

11. The method of claim 9, wherein measuring the first temperature in the tub includes measuring a temperature of air in the tub or a temperature of wash water in the tub.

12. The method of claim 9, further comprising transmitting a warning signal when the second temperature is determined to be higher than the reference temperature and the second water level is determined to be higher than the reference water level.

13. The method of claim 12, wherein the warning signal is a signal notifying the user of a malfunction of a water supply unit or a water discharge unit.

14. The method of claim 9, further comprising:

controlling the door not to be opened when the second temperature is determined to be higher than the reference temperature and the second water level is determined to be higher than the reference water level.

15. The method of claim 9, further comprising transmitting a signal indicating a state of the discharge of wash water, and transmitting a signal indicating a state of the supply of cold water.

* * * * *